US011236496B2

(12) United States Patent
Salviato

(10) Patent No.: US 11,236,496 B2
(45) Date of Patent: Feb. 1, 2022

(54) VITRIFIED CERAMIC SINK AND PRODUCTION METHOD THEREOF

(71) Applicant: Stefano Salviato, Silea (IT)

(72) Inventor: Stefano Salviato, Silea (IT)

( * ) Notice: Subject to any disclaimer, the term of this patent is extended or adjusted under 35 U.S.C. 154(b) by 101 days.

(21) Appl. No.: 16/761,965

(22) PCT Filed: Nov. 6, 2018

(86) PCT No.: PCT/IB2018/058709
§ 371 (c)(1),
(2) Date: May 6, 2020

(87) PCT Pub. No.: WO2019/087167
PCT Pub. Date: May 9, 2019

(65) Prior Publication Data

US 2021/0189706 A1 Jun. 24, 2021

(30) Foreign Application Priority Data

Nov. 6, 2017 (IT) ..... 102017000125955

(51) Int. Cl.
*E03C 1/18* (2006.01)
*E03C 1/14* (2006.01)
*E03C 1/326* (2006.01)

(52) U.S. Cl.
CPC ..... *E03C 1/18* (2013.01); *E03C 1/14* (2013.01); *E03C 1/326* (2013.01)

(58) Field of Classification Search
CPC ... E03C 1/18; E03C 1/14; E03C 1/326; E03C 1/182; B32B 37/12
USPC ..... 4/619
See application file for complete search history.

(56) References Cited

U.S. PATENT DOCUMENTS

2003/0046758 A1* 3/2003 Gerloff ..... E03C 1/18 4/619
2006/0133065 A1* 6/2006 Douglass ..... E03C 1/14 362/101
2012/0222211 A1* 9/2012 Booth ..... E03C 1/186 4/619
2012/0222212 A1* 9/2012 Booth ..... E03C 1/18 4/619

(Continued)

FOREIGN PATENT DOCUMENTS

DE 29804950 U1 7/1998

OTHER PUBLICATIONS

PCT International Search Report and Written Opinion issued by the International Bureau for PCT Application No. PCT/IB2018/058709, dated Feb. 19, 2019, pp. 1-12.

*Primary Examiner* — Benjamin R Shaw
(74) *Attorney, Agent, or Firm* — The Belles Group, P.C.

(57) ABSTRACT

A method for manufacturing an approximately parallelepiped-shaped sink comprising a series of flat rectangular slabs made of ceramic/clay material, firmly connected to one another at their relative sides. the sides of the slabs are provided with connection bevels tilted in respect to the lying planes of the respective slabs with angles sized so that the support of the flat face of a connection bevel present on a side of a slab against the flat face of the connection bevel present on a connection side of another slab, determines a mutual perpendicular positioning between the two slabs; and firmly fixing the flat faces of the connection bevel by means of an adhesive composition.

10 Claims, 7 Drawing Sheets

(56) References Cited

U.S. PATENT DOCUMENTS

| | | | | |
|---|---|---|---|---|
| 2015/0201812 | A1* | 7/2015 | Stammel | B32B 37/12 4/643 |
| 2020/0199858 | A1* | 6/2020 | Eilmus | E03C 1/18 |

* cited by examiner

FIG. 4b
FIG. 4
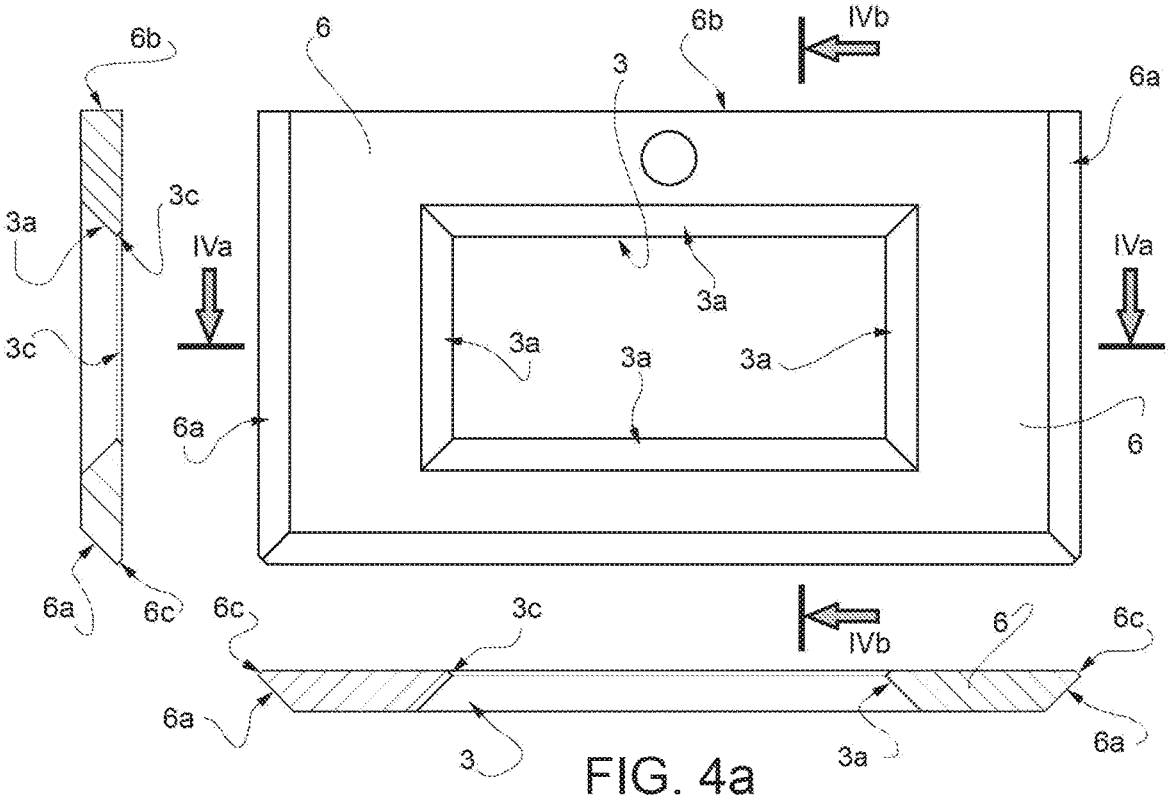
FIG. 4a
FIG. 5a
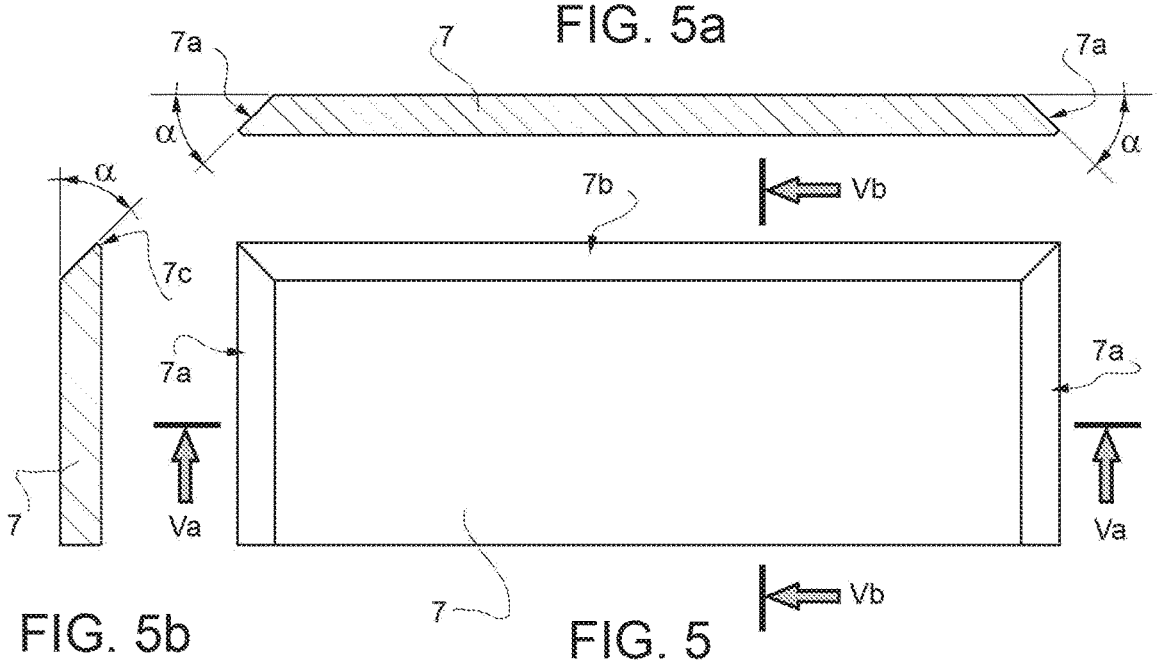
FIG. 5b
FIG. 5

VITRIFIED CERAMIC SINK AND PRODUCTION METHOD THEREOF

CROSS-REFERENCE TO RELATED PATENT APPLICATIONS

The present application is a U.S. national stage application under 35 U.S.C. § 371 of PCT Application No. PCT/IB2018/058709, filed Nov. 6, 2018, which claims priority to Italian Patent Application No. 102017000125955, filed Nov. 6, 2017. The disclosures of the aforementioned priority applications are incorporated herein by reference in their entireties.

TECHNICAL FIELD

This patent application relates to a sink in greified-vitrified ceramic/clay material and to a method of making such sink.

In particular, the present invention relates to the production of a bathroom or kitchen sink preferably of the suspended type, made of grès-stoneware, preferably porcelain grès-stoneware; which the description below will make explicit reference to without detracting from its general application.

BACKGROUND ART

It is known that the significant aesthetic appeal of porcelain grès-stoneware bathroom or kitchen sinks has recently led to a considerable commercial success of the same. Some porcelain grès-stoneware sinks have a box shape and typically comprise a countertop formed by a flat rectangular cross-section slab (or top) provided with a central through opening for housing a water collection and drainage tub. The outer perimeter edge of the top has a structured side to be fixed to the support wall of the bathroom, and three sides that are coupled below to the upper sides of three respective vertical walls, also formed by relative flat slabs with a rectangular cross-section that extend side by side below the countertop and are sized to hide the tub.

A known method for making the box-shaped sinks of the type described above, essentially involves preparing two parallel-shaped wooden support formworks arranged inside each other. A first inner formwork is sized based on the size of the tub, and a second outer formwork is sized based on the dimensions of the outer perimeter edge of the countertop. The method essentially involves coating by gluing the outer surface of the three adjacent walls of the second outer formwork with thin rectangular slabs so as to form the three vertical side walls of the sink. The method also involves positioning the lower surface of the outer perimeter edge of the countertop resting on the second outer formwork and on the three upper edges of the three vertical walls and securing it to them by means of an adhesive material or composition.

The method also involves coating the inner surface of the inner formwork facing the through opening of the countertop with thin rectangular slabs in such a way as to form a parallelepiped tub.

The sink made using the method described above has the limitation of keeping the rectangular edges of the connecting sides visible on the visible surface of the slabs, a condition that affects the aesthetic appeal of the sink. A second limitation of the sink made using the method described above is the fact that the wooden formworks remain incorporated in the sink and being exposed to the high degree of humidity typically present in a bathroom or kitchen, tend to degrade and therefore gradually decompose, determining with the passage of time consequences on the sink both from the point of view of structural stability and from the point of view of hygiene.

DISCLOSURE OF INVENTION

In this regard, the Applicant has therefore conducted an in-depth study aimed at identifying a solution able to overcome technical problems described above.

Such purpose is achieved by the present invention insofar as it relates to a method for making a sink as described in claim 1 and in the dependent claims.

Such purpose is further achieved by the present invention insofar as it relates to a sink made according to claim 8 and the dependent claims.

BRIEF DESCRIPTION OF THE DRAWINGS

The present invention will now be described with reference to the appended drawings, which illustrate an example of non-restrictive implementation, where:

FIG. 4 shows a plan view from below of the countertop of the sink shown in FIG. 1;

FIG. 4*a* is the cross-section IVa or of the countertop of the sink shown in FIG. 4;

FIG. 4*b* is the section IVb or of the countertop of the sink shown in FIG. 4;

FIG. 5 shows a plan view from below of a side wall of the sink shown in FIG. 1;

FIG. 5*a* is the cross-section Va of the side wall shown in FIG. 5;

FIG. 5*b* is the cross-section Vb of the side wall shown in FIG. 5;

BEST MODE FOR CARRYING OUT THE INVENTION

Figure 1:
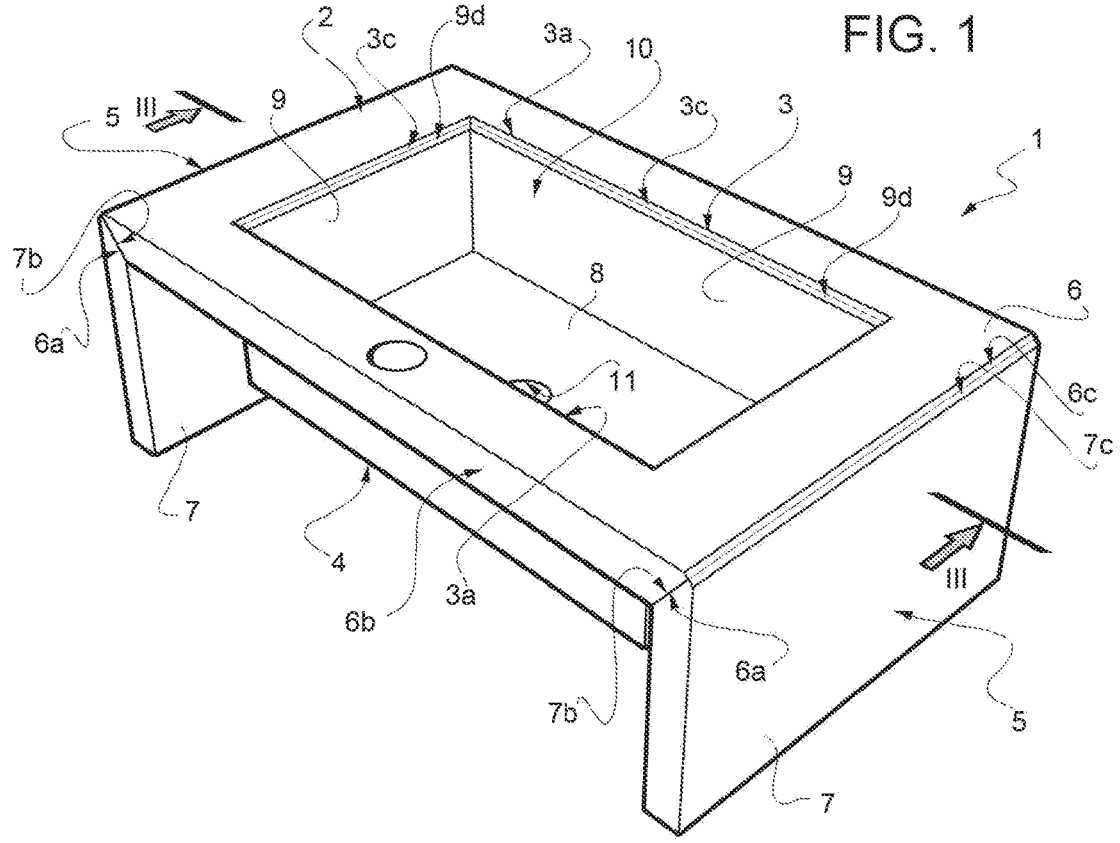
FIG. 1 is a perspective view of a sink made according to a first embodiment of the present invention.

The present invention will now be described in detail with reference to the appended figures to enable a person skilled in the art to make and use it. Various modifications to the embodiments described will be immediately apparent to the person skilled in the art and the general principles described may be applied to other embodiments and applications while remaining within the sphere of protection of the present invention, as defined in the appended claims. The present invention should not therefore be considered limited to the embodiments described and illustrated, but given a broader scope of protection according to the principles and characteristics described and claimed herein.

With reference to the appended drawings, reference numeral 1 globally denotes a sink made of greified-vitrified ceramic/clay material. In the description below, the term greified-vitrified ceramic/clay material will be understood to mean material predominantly made of waterproof hard ceramic paste and preferably comprising grès-stoneware. The grès-stoneware may preferably correspond to a porcelain grès-stoneware. Conveniently, the sink may be a kitchen or bathroom wash basin, parallelepiped in shape, preferably but not necessarily of a suspended type.

According to a preferred embodiment shown in FIG. 1, the sink 1 has an approximately parallelepiped shape and comprises a countertop 2, in the jargon "top" provided with at least one through opening 3 suitable to internally house a water collection and drainage tub 4, and at least three lower perimeter walls 5 integral with three respective outer sides of the countertop 2. The perimeter walls 5 extend below the countertop 2 conveniently lying on respective planes perpendicular to the same and may be sized based on the length of the outer sides of the countertop 2 and/or the size of the tub 4. The tub 4 may be made of metal and may be arranged under the countertop 2. The tub 4 can be fixed integrally to the lower surface (not visible) of the countertop 2 with its upper perimeter edge 4*a* so as to present its inner surface facing the opening 3.

Figure 2:
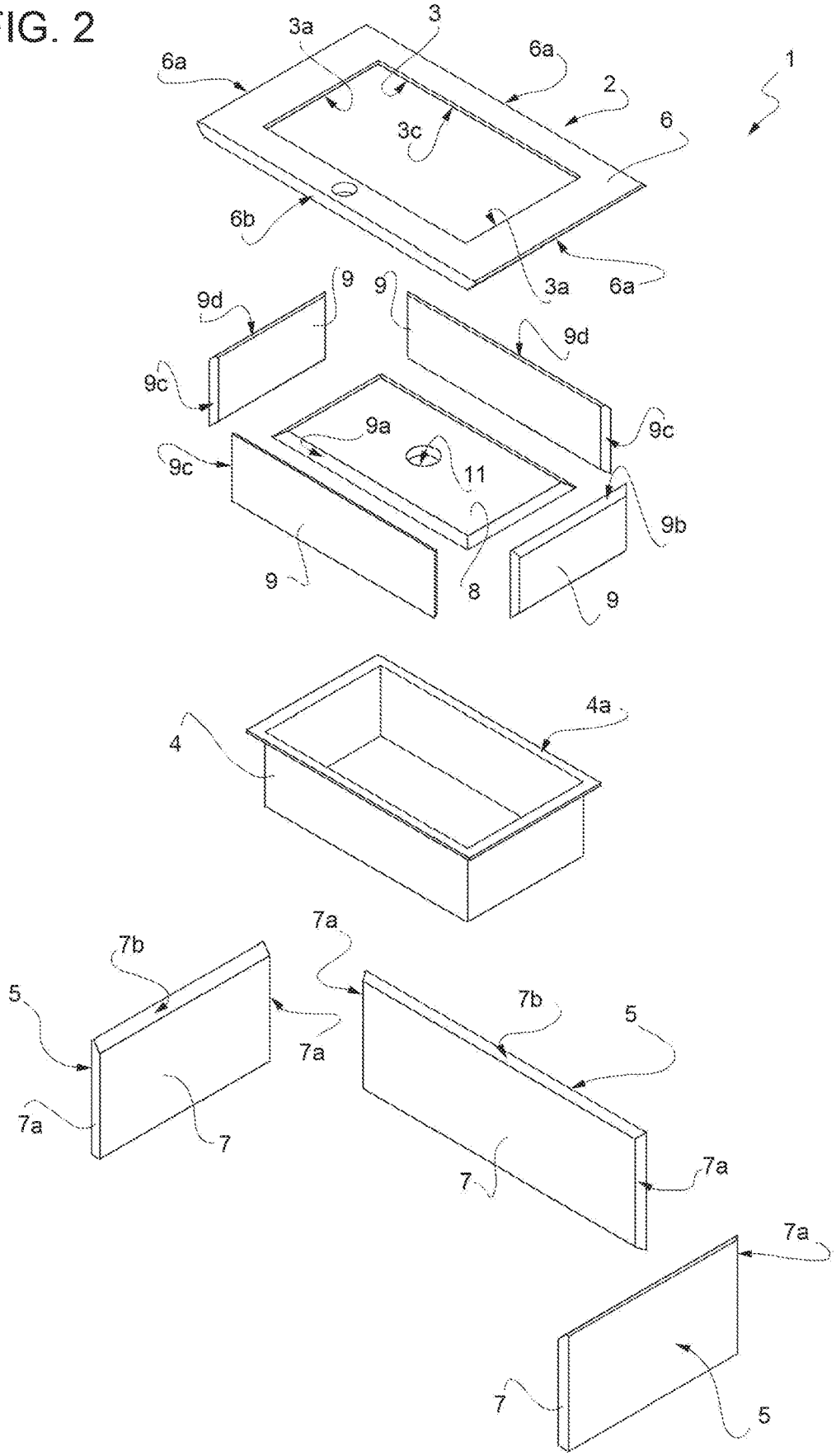
FIG. 2 is an enlarged view of the sink shown in FIG. 1.
Figure 6B:
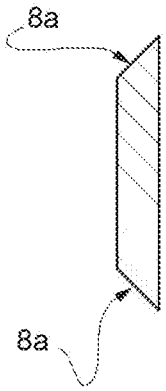
FIG. 6*b* is the cross-section VIb of the bottom wall shown in FIG. 6.
Figure 6:
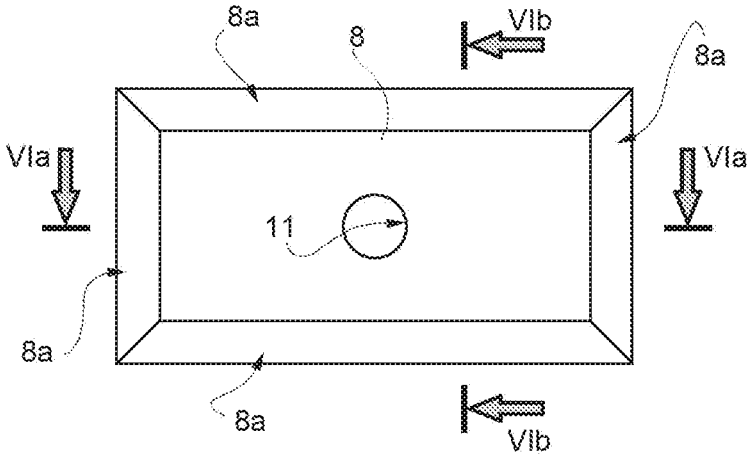
FIG. 6 shows a plan view from below of a bottom wall of the sink shown in FIG. 1.
Figure 6A:
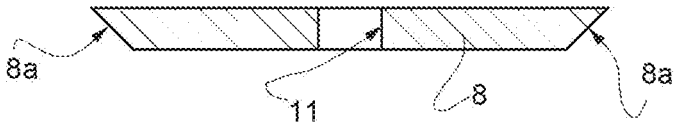
FIG. 6*a* is the cross-section VIa of the bottom wall shown in FIG. 6.
Figure 7B:
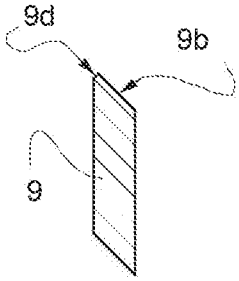
FIG. 7*b* is the cross-section VIIb of the side wall to the bottom wall shown in FIG. 6.
Figure 7:
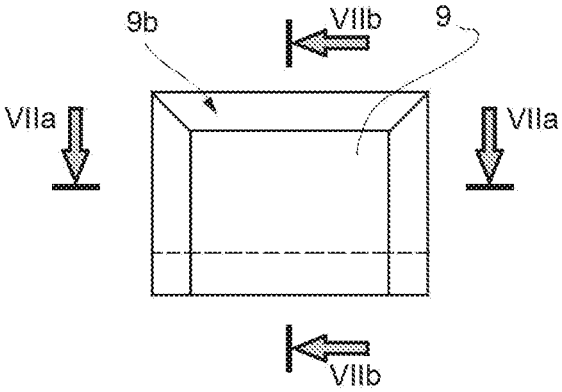
FIG. 7 shows a plan view from below of a side wall to the bottom wall of the sink shown in FIG. 1.
Figure 7A:
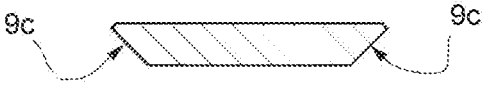
FIG. 7*a* is the cross-section VIIa of the side wall to the bottom wall shown in FIG. 7.

According to the preferred embodiment shown in FIGS. 1 and 2, the countertop 2 may comprise a flat rectangular slab 6 made of vitrified ceramic/clay based material, on which the opening 3 is obtained. Conveniently in the example shown in the appended Figures, the flat slab 6 is arranged on a preferably horizontal reference plane and has an outer edge or side 6*b* structured to be fixed to a vertical support wall (not illustrated), and at least three horizontal side edges or sides 6*a*, to which the three perimeter walls 5 are stably coupled, respectively.

Figure 3:
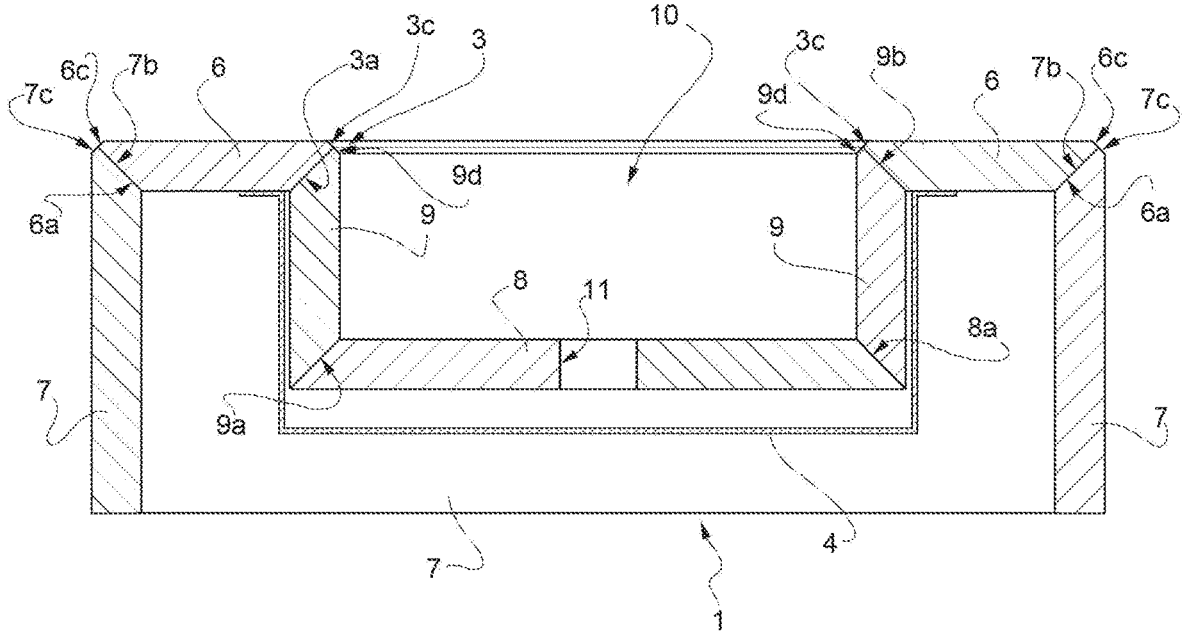
FIG. 3 is a cross-section III-III of the sink shown in FIG. 1.

According to the preferred embodiment shown in FIGS. 1 and 2, the perimeter walls 5 comprise at least three rectangular flat slabs 7 made of vitrified ceramic/clay based material each having at least one vertical edge or side 7*a* integrally connected with a vertical side 7*a* of the adjacent slab 7. The vertical side 7*a* of the slab 7 is bevelled and arranged in abutment on a corresponding bevel of a side 7*a* of an adjacent slab 7. The connection bevels of the vertical sides 7*a* of the slabs 7 are tilted with respect to the lying planes of the relative slabs 7 so that their mutual support causes the arrangement of the slabs 7 in respective lying planes perpendicular to each other (FIGS. 1 and 3).

Each slab 7 also has a bevelled upper side 7*b* that is arranged in abutment on a corresponding bevelled side 6*a* of the slab 6. The connection edges or bevels of the sides 7*b* of the slabs 7, and of the side 6*a* of the slab 6 are tilted with respect to the lying plane of the relative slabs 7 and respectively 6, so that their mutual support causes the positioning of the slabs 7 and 6 in lying planes perpendicular to each other (FIGS. 1 and 3).

According to the present invention, the connection edges or bevels of the sides 7*a* and 7*b* of the slabs 7 and the edges or bevels of the sides 6*a* of the slab 6 are internal, i.e. they are each made towards the inner surface (non-visible surface of the sink 1) of the relative slab 7 and respectively slab 6 so as to remain hidden (out of sight). Preferably, the inner bevels are made along about the entire length of the relative sides 7*a* and 7*b* of the slabs 7 and the sides 6*a* of the slab 6, for about the entire thickness of the same, so as to each form an elongated rectangular support face of an approximately flat and smooth shape oriented towards the inner surface of the relative slab and lying on a plane forming a predetermined angle $\alpha$ with the flat outer surface of the said relative slab 7 and 6. The support faces formed by the connection bevels of the sides 7*a* of two adjacent slabs 7 are conveniently arranged in abutment and integral with each other, preferably by gluing, and are mutually tilted to ensure that the relative slabs 7 are approximately perpendicular to each other. Similarly, the support faces formed by the connection bevels of the upper horizontal sides 7*b* of the slabs 7 and the connection bevels of the sides 6*a* of the upper slab 6 are conveniently arranged in abutment and integral with each other, preferably by gluing, and are mutually tilted to ensure that the relative slabs 7 and 6 are approximately perpendicular to each other.

The angle of inclination $\alpha$ of the faces formed by the connection bevels of the edges 7*a*, 7*b* and 6*a* with respect to the outer surface of the slabs 7 and respectively 6 may be between about 30° and about 60°. It is understood that in this case the angles of inclination $\alpha$ of the two connection bevels of the two mutually connected slabs 7 and 6 are dimensioned so that their sum is about 90°. Preferably, the tilting angle $\alpha$ is approximately 45°. Conveniently the thickness of the slabs 7 and/or 6 may be between about 10 mm and about 14 mm, preferably about 12 mm.

According to a preferred embodiment shown in the appended drawings, the opening 3 is conveniently approximately rectangular or square and may be made on the slab 6 so as to present its four inner sides 3*a* oriented so as to be approximately parallel to its four outer adjacent sides of the countertop 2.

In the example illustrated in FIGS. 1 and 3, the sides 6*a* of the slab 6 also conveniently have an exposed bevel 6*c* made on the exposed slab surface 6 surface tilted with respect to the same. Preferably, the sides 7*b* of the slabs 7 conveniently each have an exposed bevel 7*c* made on the exposed surface of the slab 7, tilted with respect to the same so as to be preferably coplanar with the exposed bevel 6*c* of the side 6*a*. Preferably, exposed bevels 6*c* and 7*c* are formed of flat faces and their tilting angle with respect to the relative slabs 6 and respectively 7 can correspond to angle $\alpha$. Preferably, the width of the exposed bevel 6*c* and the width of the exposed bevel 7*c* may be between about 0.5 and 1.5 mm, preferably about 1 mm.

In the example illustrated in FIGS. 1 and 3, the sink further comprises a substantially parallelepiped-shaped cup liner body 10 which is arranged inside the opening 3 and extends below the slab 6 so as to be arranged facing the inner surface of the tub 4 to coat the same.

According to a possible exemplary embodiment shown in the appended drawings, the cup liner body 10 has a bottom wall made of an approximately rectangular or square slab 8 made of vitrified ceramic/clay based material components, facing the bottom of the tub 4. The cup liner body 10 further comprises four side walls formed by as many approximately rectangular or square slabs 9 also made of vitrified ceramic/clay based material components, which laterally surround the slab 8 of the bottom wall under the slab 6. According to a possible exemplary embodiment shown in the appended drawings, the slabs 9 are arranged perpendicular to each other and to the slab 6. According to a possible exemplary embodiment shown in the appended drawings, each side slab 9 may have the bevelled lower side 9*a* connected to a bevelled side 8*a* of the bottom slab 8, the bevelled upper side 9*b* connected to a bevelled inner side 3*a* of the opening 3 of the slab 6, and each bevelled vertical side 9*c* connected to a respective bevelled vertical side 9*c* of an adjacent orthogonal slab 9.

According to a preferred exemplary embodiment shown in the appended drawings, the connection edges or bevels of the upper and vertical sides 9*b* and 9*c* of each slab 9 are internal, i.e. each made towards the inner surface (surface not in view of the sink) of the said slab 9 so as to remain hidden (out of sight). However, with regard to the edges or bevels of the lower sides 9*a* of each slab 9, they may be external, i.e. obtained on the outer surface of said slab 9.

According to a preferred exemplary embodiment shown in the appended drawings, also the connection bevels of the sides 8*a* of the slab 8 are preferably internal i.e. each made on/towards the inner surface of said slab 8 so as to remain hidden (out of sight).

Conveniently, the inner connection bevels are made along approximately the entire length of the relative sides 9*a* and 9*c* of the slabs 9, and of the sides 8*a* of the slab 8, approximately for the entire thickness of the same, and are each formed by a rectangular and elongated tilted support face.

The face formed by each inner bevel is preferably flat and smooth, is oriented towards the inner surface of the relative slab 8 and 9 and lies on a plane forming a predetermined angle β with the flat outer surface of said slab 8 and 9. The support faces formed by the bevels of the vertical sides 9*c* of two adjacent slabs 9 are conveniently arranged in abutment and integral with each other, preferably by gluing, and are mutually tilted to ensure that the two slabs 9 connected are approximately perpendicular to each other. Similarly, the support faces formed by the connection bevels of the lower horizontal sides 9*a* of the slabs 9 and the connection bevels of the sides 8*a* of the slab 8 of the bottom wall are conveniently arranged in abutment and integral with each other, preferably by gluing, and are mutually tilted to ensure that the slabs 9 are perpendicular to the slab 8 of the bottom wall. The tilting angle β of the faces formed by the bevels of the sides 9*c*, 9*b*, 9*a* and 8*a* with respect to the relative slabs 9 and respectively 8 may be between about 30° and about 60°. It is understood that in this case the tilting angles β of the two connection bevels of the two mutually connected slabs are dimensioned so that their sum is about 90°. Preferably, the tilting angle β is about 45°. Conveniently the thickness of the slabs 8 and/or 9 may be between about 4 mm and about 6 mm, preferably about 5 mm.

In the example illustrated in FIGS. 1 and 3, each of the inner sides 3*a* of the opening 3 of the slab 6 also conveniently have an exposed bevel 3*c* made on the exposed slab surface 6 and formed by a flat face tilted with respect to the same. Preferably, also the upper sides 9*b* of the slabs 9 conveniently each have an exposed bevel 9*d* made on the exposed surface of said slab 9 forming a face tilted with respect to the slab 9 so as to be preferably coplanar to the face of the bevel 3*c* of the side 6*a*. Preferably, the exposed bevels 3*c* and 7*c* are formed of flat faces and their angle of inclination with respect to the relative slabs 6 and respectively 9 can correspond to the angle β. Preferably, the width of the exposed bevel 3*c* and the width of the exposed bevel 9*d* may be between about 0.5 and 1.5 mm, preferably about 1 mm.

The method for making the sink 1 described above with reference to the schematic examples shown in FIGS. 8 to 13 will be described below. The method comprises the steps of preparing:

- a rectangular flat slab 6 of a parallelepiped shape having non-bevelled sides 6*a*, i.e. each having an outer edge having a preferably rectangular cross-section; on the slab 6 the rectangular opening 3 may be made the inner sides 3*a* of which may be non-bevelled, i.e. each having an edge with a preferably rectangular cross-section;
- at least three rectangular flat slabs 7 of parallelepiped shape each of which has its non-bevelled sides 7*a* and 7*b*, i.e. each having an outer edge with a preferably rectangular cross-section; it is understood that the slabs 7 are sized based on the length of the sides 6*a* of the slab 6 and/or the height of the tub 4; preferably, the length of the slabs 7 may correspond approximately to the length of the corresponding outer sides 6*a* of the slab 6;
- at least four rectangular flat slabs 9 of parallelepiped shape each of which has its non-bevelled sides 9*a*, 9*b* and 9*c*, i.e. each having an outer edge with a preferably rectangular cross section; it is understood that the slabs 9 are sized based on the length of the sides 3*a* of the opening 3; preferably, the sides 9*b* of the slabs 9 may be about the length of the corresponding inner sides 3*a* of the opening 3;
- at least one rectangular flat slab 8 of parallelepiped shape having its non-bevelled sides 8*a*, i.e. each having an outer edge with a preferably rectangular cross-section; preferably, the length of the sides 8*a* of the slab 8 may correspond to the length of the corresponding inner sides 3*a* of the opening 3; and
- a tub 4 preferably made of steel alloy or similar materials.

The method involves a first step of making the connection bevels along the sides of the slabs making up the sink 1. The first step involves making the internal connection bevels on at least three horizontal sides 6*a* of the slab 6, the internal connection bevels on the sides 7*a* and 7*b* and the slabs 7, the internal connection bevels on the sides 8*a* of the slab 8 and the internal connection bevels 9*b* and 9*c* on the slab 9. The first step also involves making connection bevels on the sides 9*a* of the slabs 9. Conveniently this step can be performed by means of a machine tool 100 (FIG. 11) fitted with cutting tools 101 structured to cut each slab along each side to be bevelled. Conveniently, the tool 101 may comprise, for example, a cutting disc, or a milling cutter, or a rotating abrasive grinding wheel. The first step may provide for abrasion or cutting along the inner edge of the slab side for about the entire length of the slab so as to make the connection bevel. Conveniently, the first step may include: making by means of the tool 101, an inner connection bevel having the angle α along at least the three sides 6*a* of the slab 6; making by means of the tool 101 an inner connection bevel having the angle α along at least the sides 3*a* and the opening 3; making by means of the tool 101 an inner connection bevel having the angle α along at least the sides 7*a* and 7*b* of the slabs 7.

Figure 8:
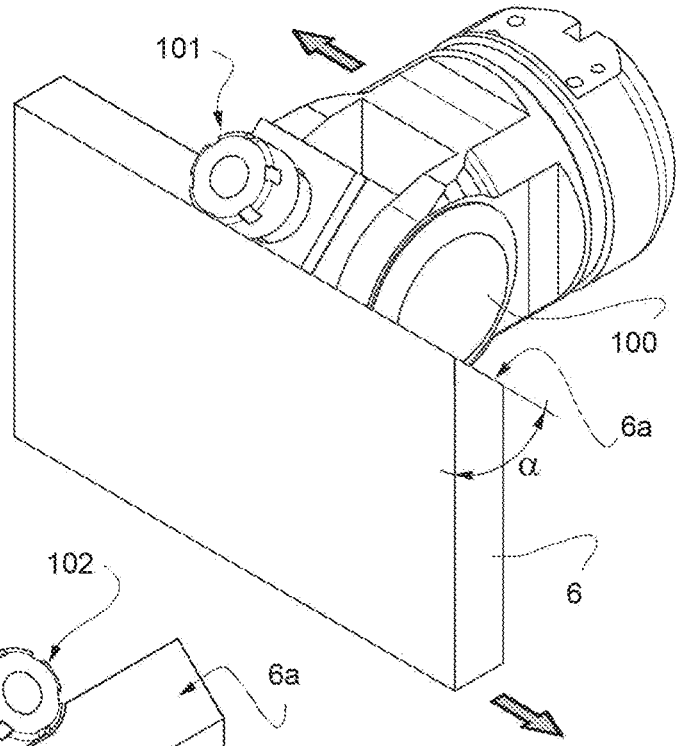
FIG. 8 shows schematically an operating phase of the method for making the inner bevel on one side of a slab.

Conveniently during the first step, an end prismatic portion present along the side of the slab 6 and 7 can be removed, with a cut preferably tilted by 45° with respect to the lying plane of said slab 6 and respectively 7. Conveniently, the first step may further comprise: making, by means of the tool 101, a bevel having the angle β along the four sides 8*a* of the slab 8, and along the sides 9*a*, 9*c* and preferably 9*b* of the slabs 9. In FIG. 8, by way of example, the realization of the 45° bevel on a side 6*a* of the slab 6 is shown schematically. It is understood that the realization of the bevels on the sides 7*a* and 7*b* of the slabs 7, on the sides 8*a* of the slab 8 and on the sides 9*a*, 9*c* and 9*b* of the slabs 9 is carried out in a manner similar to that shown in FIG. 8. The Applicant has found that the most convenient embodiment involves making bevels along the sides of the slabs having an angle α and an angle β, of about 45°.

The method may further, preferably but not necessarily, include a step of making on the slab 8 *a* through hole 11 suitable to drain the water into the tub 4 below.

Figure 9:
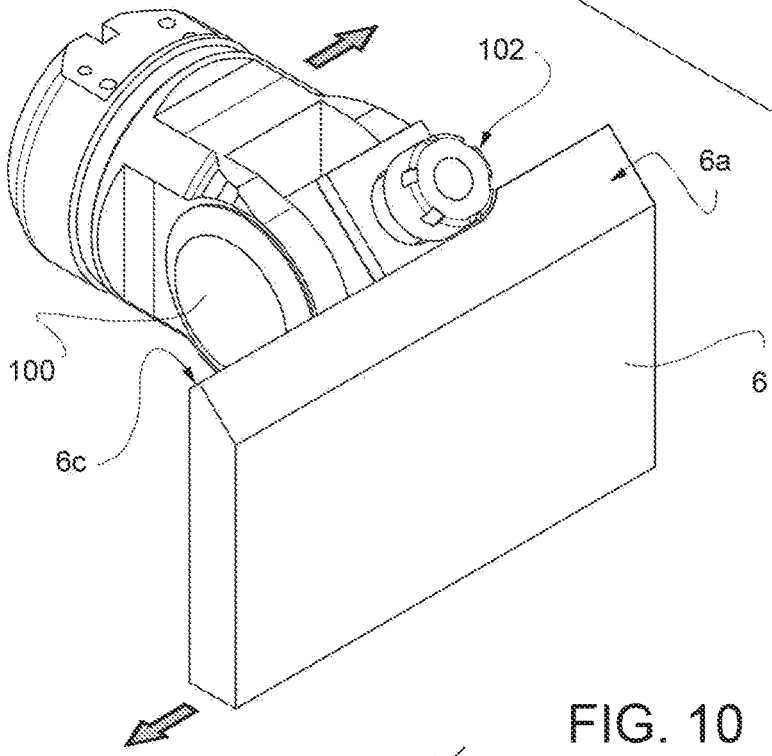
FIG. 9 schematically shows an operating phase of the method for making the outer bevel on one side of a slab.

The first step may further provide for making the exposed bevels 6*c* on the sides 6*a* of the slab, the exposed bevels 7*c* on the sides 7*b* of the slabs 7, the exposed bevels 3*c* on the sides 3*a* of the opening 3 of the slab 6 and the exposed bevels 9*d* on the sides 9*a* of the slab 9. Conveniently this step can be performed by means of a machine tool 100 (FIG. 11) fitted with cutting tools 102 structured to cut each slab along each side to be bevelled. In FIG. 9 by way of example only, the realization of the exposed bevel 6*c* of 45° on the side 6*a* of the slab 6 is shown schematically. It is understood that the realization of the exposed bevels 7*c* on the sides 7*b* of the slabs 7, of the exposed bevels 3*c* on the sides 3*a* of the opening 3 of the slab 6 and of the exposed bevels 9*d* on the sides 9*a* of the slab 9 is carried out on each slab in a manner similar to that shown in FIG. 9.

Figure 10:
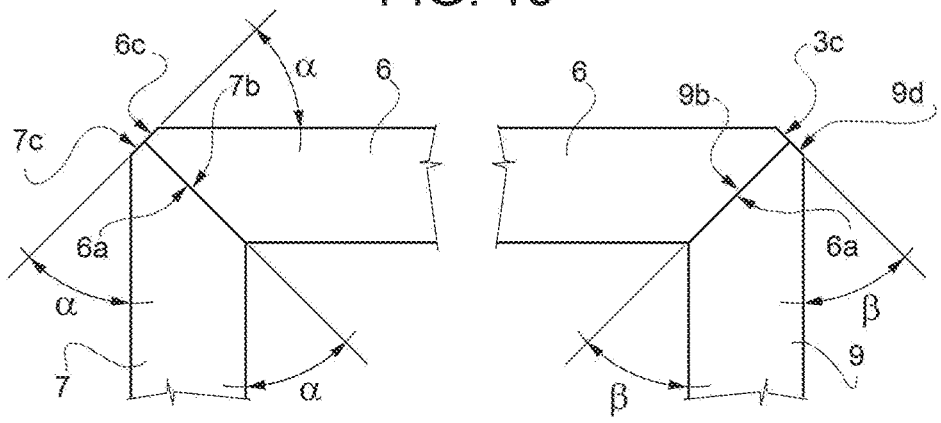
FIG. 10 shows schematically two details in enlarged scale of a vertical cross-section of the sink shown in FIG. 1 at two connection points of the slabs.

Conveniently, each of the exposed bevels 6*c*, 7*c*, 3*c*, 7*c*, 9*d* can be made by means of a second tool 102 of the tool machine 100. Preferably, the first operating step may provide for simultaneously realising on the same side of each slab 6, 7, 8 and 9, the connection bevel and the exposed bevel, by means of the first and respectively the second tool 102. Preferably, the first operating step may provide for simultaneously making the inner bevel and the outer bevel on the side of the same slab by means of the first 101 and respectively the second tool 102 mounted in the same machine tool 100 (FIGS. 8-10).

Figure 11:
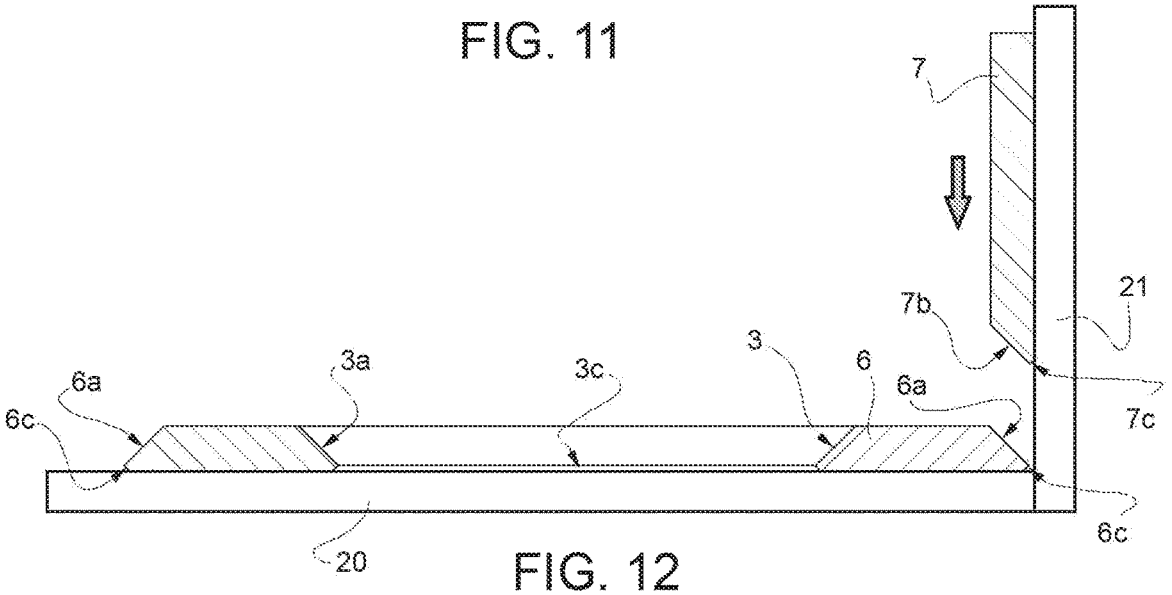
FIGS. 11, 12 and 13 show schematically as many operating phases of the assembly of the sink.
Figure 12:
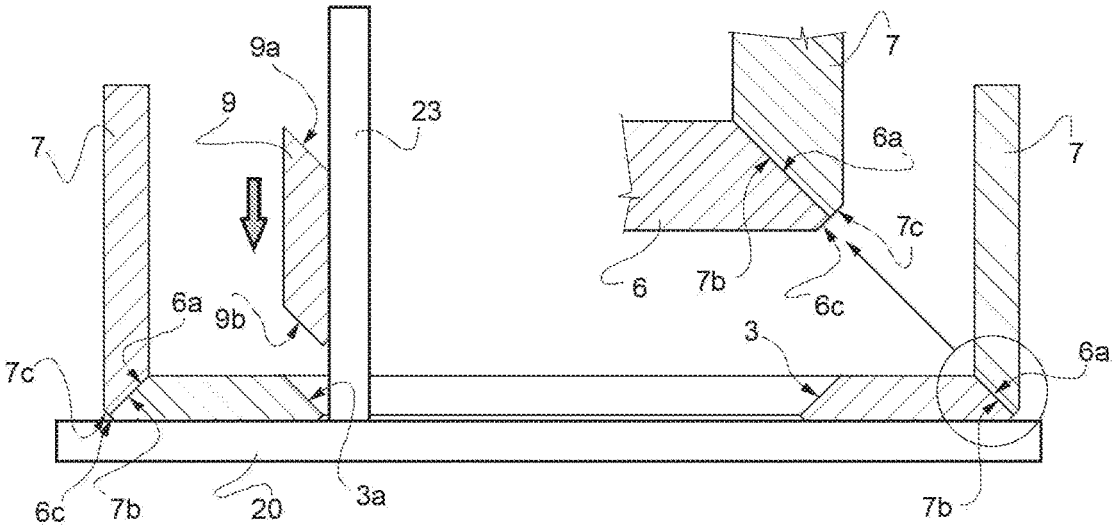
Figure 13:
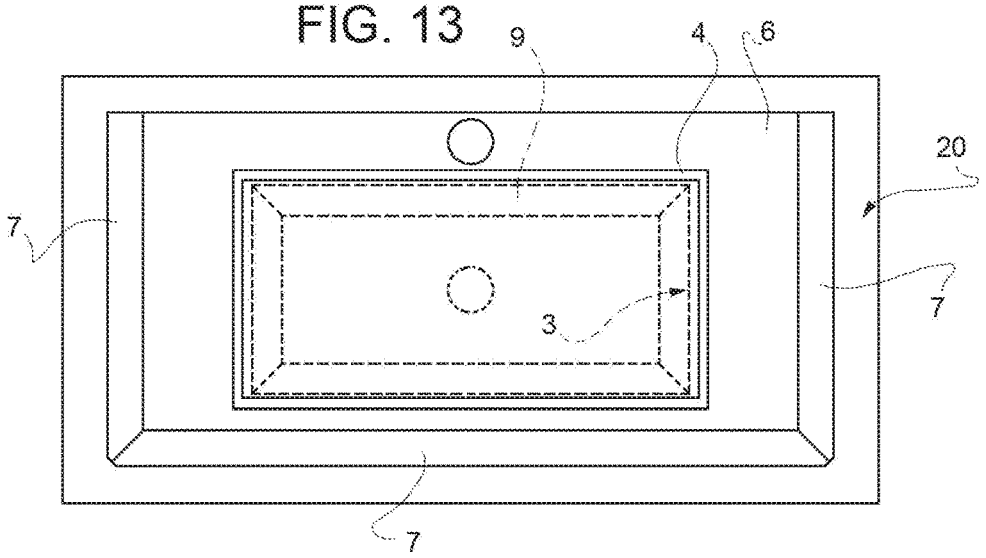

The method also provides for a second step in which the slabs are assembled for the realization of the sink 1 (FIG. 11-13). The second step may include positioning the slab 6 on a support plane 20 preferably approximately horizontal, of a support and assembly structure (not illustrated) preferably with the exposed surface resting on it, and the inner bevels connecting the sides 6*a* facing upwards, and with a first side 6*a* abutting against a coupling wall 21 perpendicular to the support plane 20. The second step may further provide for positioning the first slab 7 above the slab 6 with its outer surface resting against the vertical coupling wall 21 and with the connection bevel of the side 7*b* facing the side opposite said vertical coupling wall 21. The first slab 7 is then made to slide resting along the vertical coupling wall 2 so as to conveniently arrange the connection bevel of the side 7*b* resting on the connection bevel of the side 6*a* of the slab 6 below. The second step further comprises the step of depositing an adhesive material on the faces formed by the two connection bevels of the first side 7*b* and the first side 6*a* so as to stably secure the first slab 7 to the slab 6 (FIG. 11).

It is understood that the adhesive material may comprise any adhesive material of a known type suitable for fixing grès-stoneware or similar materials. For example, an adhesive material could be a methacrylate-based adhesive or similar components such as fast polymerization, permanently elastic and high cohesion materials. In this regard, for example, possible products to be used may be the adhesive compositions COMPOSITE BONDER RTP 01 of INTEGRA ADHESIVES, or MS POLIMER CRYSTAL SOKEM of NOXORSOKEM CHEMICALS MAKING SOLUTIONS GROUP srl.

The second step of assembling the sink 1 preferably involves repositioning the slab 6 on the horizontal support plane 20, keeping the upper surface of the same resting on it, and arranging a second free side 6*a* adjacent to the first side 6*a* previously coupled with the first slab 7, against the vertical coupling wall 23.

The second step of assembling the sink 1 preferably involves positioning the outer surface of a second slab 7 resting against the vertical coupling wall 21 and carrying out the same assembly operations of the first slab 7 so as to arrange the connection bevel of the side 7*b* resting on the bevel of the second side 6*a* of the underlying slab 6 and the connection bevel of the vertical side 7*a* resting on the bevel of the vertical side 7*a* of the first slab 7 previously coupled to the slab 6. The second step further comprises the step of depositing an adhesive material both on the faces formed by the bevels of the second side 6*a* and of the side 7*b*, and on the faces formed by the bevels of the two vertical sides 7*a*. In this way, the second slab 7 is permanently fixed to both the slab 6 and the first slab 7 and is, thanks to the bevels, perpendicular to the same. The second operation described above is then repeated in a similar manner to stably connect the third slab 7 to the slab 6 to the adjacent second slab 7.

The method further comprises a third step for forming the cup liner body 11 attached to the slab 6. The third step involves positioning the slab 6 in such a way as to arrange a first bevelled side 3*a* of the opening 3 resting against a coupling wall 23 perpendicular to the support plane 20. It is understood that the vertical coupling wall 23 may comprise one or more vertical panels, preferably interchangeable, sized based on the dimensions of the sides 3*a* of the opening 3.

The third step also involves positioning the inner surface of a first slab 9 above the slab 6 and with its outer surface resting against the vertical coupling wall 23 so as to arrange the connection bevel of the upper side 9*b* on the opposite side to the vertical coupling wall 23. The third step further involves sliding the first slab 9 downwards, keeping it resting on the wall 23 in such a way as to arrange the connection bevel of the upper side 9*b* in abutment on the corresponding connection bevel of the first side 3*a* of the opening 3 of the underlying slab 6. The third step further comprises the step of depositing an adhesive material on the faces formed by the pair of bevels of the sides 3*a* and 9*b* so as to render them mutually integral. In this way, the first slab 9 is permanently fixed to the slab 6 and is, thanks to the bevels, perpendicular to the same.

According to a possible exemplary embodiment in which the use of a single coupling wall 21 is provided for, the third step may further provide for repositioning the slab 6 and/or the vertical coupling wall 23 so as to arrange a second bevelled side 3*a* of the opening 3 resting against the said wall 23.

The third step preferably involves positioning the outer surface of a second slab 9 resting against the vertical coupling wall 23 and performing the same assembly operations of the first slab 9 so as to arrange the connection bevel of the side 9*b* resting on the bevel of the second side 3*a* of the opening 3 of the underlying slab 6 and simultaneously the connection bevel of the vertical side 9*c* resting on the bevel of the vertical side 9*c* of the first slab 9 previously coupled to the slab 6. The second step further comprises the step of depositing an adhesive material both on the faces formed by the bevels of the second side 3*a* and of the side 9*b*, and on the faces formed by the bevels of the two vertical sides 9*c*. In this way, the second slab 9 is permanently fixed to both the slab 6 and the first slab 9 and is, thanks to the bevels, perpendicular to the same. The second operation described above is then repeated in a similar manner also to stably connect the third and fourth slabs 9 to the slab 6 to the adjacent slab(s) 9.

Figure 14:
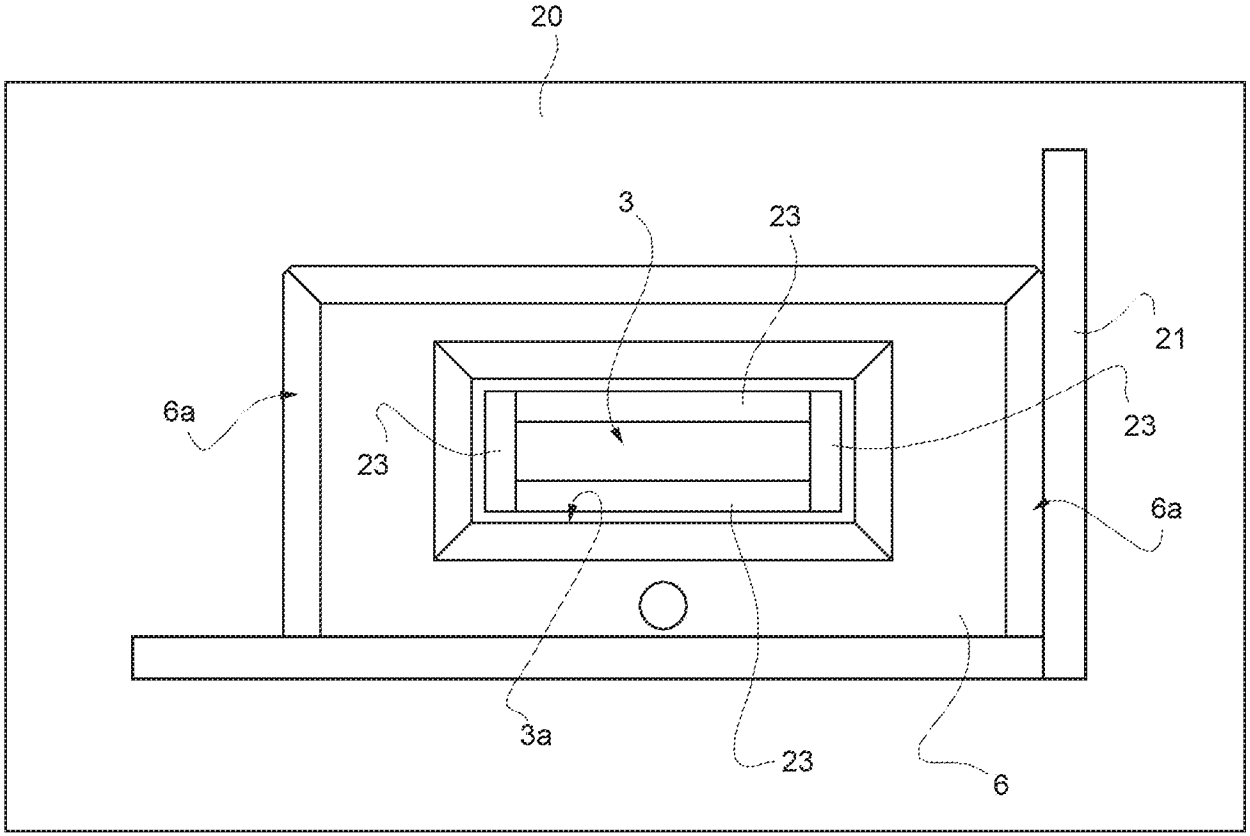
FIG. 14 shows a schematic view from above of a horizontal support plane and of four vertical coupling walls used in the method according to the present invention.

It is understood that the present invention is not limited to the use of a coupling wall 23, but according to the embodiment variant shown in FIG. 14 can provide for four coupling walls 23 arranged vertically with the sides juxtaposed so as to form a rectangle extending above the support plane 20. In this case it is conveniently possible to perform the operation described above for all the slabs 9 in a shorter time.

The third step further comprises the step of arranging the slab 8 relative to the bottom wall above the slab 6, in a horizontal position with the outer surface facing the inner surface of said slab 6. The third step further involves positioning the connection bevels of the four sides 8*a* resting on the respective lower bevels 9*a* of the four slabs 9 previously fixed to the slab 6. The third step further comprises in addition the step of stably securing the connection bevels of the four sides 8*a* with the four connection bevels of the lower sides 9*a* by means of an adhesive material.

The method comprises a fourth stage of assembly of the tub 4. The fourth step involves permanently fixing the tub 4 to the slab 6. The third step may provide for arranging the tub 4 above the slab 6 with its bottom upwards and opening downwards and arranging it resting with its edges 4*a* on the lower surface of the slab 6 (which in the drawing is facing upwards) surrounding the opening 3 and the cup liner body 10 and fixing them to the same with an adhesive material.

The advantages of the sink described above are evident.

The sink consists solely of rectangular flat slabs made of vitrified ceramic/clay materials, and is therefore free of any wooden formworks, thus eliminating the technical problems associated with the latter. The realization of 45° internal bevels for the mutual coupling of the sides of the slabs in addition to aesthetically eliminating the presence of any contour line defining the sides, allows a quick assembly of the sink through simple and quick steps with a high coupling precision thanks also to the preparation of the horizontal support plane and the vertical coupling wall.

Furthermore, the construction of the external bevel directly on the outer edge of the slabs through a machining carried out with a machine tool makes it possible to obtain perfectly straight bevel edges, without any imperfections or irregularity that would affect the aesthetic quality of the sink itself.

Lastly it is clear that modifications and variants may be made to the sink described and illustrated herein while remaining within the protective scope of the present invention, as defined by the appended claims.

The invention claimed is:

1. A method for manufacturing an approximately parallelepiped-shaped sink (1) comprising a series of flat rectangular slabs (6)(7)(8)(9) made of ceramic/clay material, firmly connected to one another at their relative sides (6*a*)(3*a*), (7*a*)(7*b*), (8*a*), (9*a*)(9*b*)(9*c*);

said method being characterised in that it comprises the following steps of:

producing on said sides (6*a*)(3*a*), (7*a*)(7*b*), (8*a*), (9*a*)(9*b*)(9*c*) of said slabs (6), (7), (8), (9) the connection bevels tilted at predetermined angles (α) (β) in respect to the lying planes of the respective slabs (6), (7), (8), (9), so that the support of the flat face of a connection bevel present on a side of a slab, against the flat face of the connection bevel present on a connection side of another slab, determines a mutual perpendicular positioning between the two slabs; and firmly fixing the flat faces of the connection bevel and the sides of said slabs to one another, positioned perpendicularly in respect to one another, by an adhesive composition.

2. The method according to claim 1 comprising the steps of:

arranging a first slab (6) and a second slab (7) resting on two respective planes (20) (21) approximately perpendicular to one another;

moving at least one of the two slabs (7) towards the other (6) keeping it approximately rested on a relative plane (21) for positioning a connection bevel of a relative side (7*b*) rested on a corresponding connection bevel of a side (6*a*) parallel to the other slab (6), and/or the bevel of its own side (7*a*) rested perpendicularly on the connection bevel of a side (7*a*) parallel to an adjacent orthogonal slab (7).

3. The method according to claim 1, wherein it comprises the step of producing said connection bevels on said sides (6*a*)(3*a*), (7*a*)(7*b*), (8*a*), (9*a*)(9*b*)(9*c*) with a predetermined angle (α) (β) of approximately 45°, in respect to the lying plane of the relative slabs (6)(7)(8)(9).

4. The method according to claim 1, comprising the step of obtaining said connection bevels (6*a*)(3*a*), (7*a*)(7*b*), (8*a*), (9*a*)(9*b*)(9*c*) predominantly on the unexposed surface of said slabs (6)(7)(8)(9), so that the mutual connection renders the slabs not visible.

5. The method according to claim 1, comprising the step of obtaining, before the mutual connection of said slabs, on some connection sides of said slabs (6)(7)(9) of the exposed bevels (6*c*) (3*c*), (7*c*), (9*d*) predominantly on the visible surface of said slabs (6)(7)(9) with a predetermined angle in respect to the relative slabs (6)(7)(9) so that each pair of side-by-side exposed bevels (6*c*) (3*c*), (7*c*), (9*d*) of two mutually connected sides are substantially coplanar to one another.

6. The method according to the claim 5 comprising the steps of producing, on a connection side of a slab (7) (6) said internal and exposed bevels by means of two relative tools (101) (102).

7. The method according to any one of the previous claim 1, wherein said sink (1) comprises an approximately horizontal countertop (2) formed by an upper slab (6) which has at least one through opening (3) facing an underlying sink (4); and a series of vertical walls each formed by a rectangular lateral slab (7) which extend beneath the upper slab (6) on a plane perpendicular thereto and having an upper connection side (7*b*) firmly connected to a horizontal side (6*a*) of said upper slab (6) and a vertical connection side (7*a*) firmly connected to a vertical connection side (7*a*) of an orthogonal and adjacent lateral slab (7);

said method comprising the steps of:

arranging said rectangular flat slab (6) having said opening (3);

arranging a series of said rectangular flat lateral slabs (7);

producing the connection bevels tilted at said predetermined angle on said horizontal sides (6*a*) of said upper slab (6), on said vertical connection side (7*a*) and on said upper connection side (7*b*) of said lateral slabs (7), arranging the exposed surface of said slab (6) resting on an approximately horizontal plane (20);

arranging the exposed surface of said lateral slab (7) resting on an approximately vertical plane (21);

moving said lateral slab (7) towards said upper slab (6) keeping it approximately rested on a relative vertical plane (21) for positioning the connection bevel of the horizontal side (7*b*), resting on a corresponding horizontal bevel side (6*a*) of the upper slab (6), and/or vertical bevel side (7*a*) resting on the vertical bevel side (7*a*) of an adjacent slab (7);

mutually fixing the bevels by means of an adhesive composition.

8. An approximately parallelepiped-shaped sink (1) comprising a series of rectangular flat slabs (6)(7)(8)(9) of a ceramic/clay material firmly connected to one another at relative connection sides (6*a*)(3*a*), (7*a*)(7*b*), (8*a*), (9*a*)(9*b*)(9*c*);

said sink being characterised in that the sides (6*a*)(3*a*), (7*a*)(7*b*), (8*a*), (9*a*)(9*b*)(9*c*) of the slabs (6)(7)(8)(9) are provided with connection bevels tilted in respect to the lying planes of the respective slabs (6)(7)(8)(9) with angles (α) (β) sized so that the support of the flat face of a connection bevel present on a side of a slab against the flat face of the connection bevel present on a connection side of another slab, determines a mutual perpendicular positioning between the two slabs; and the flat faces of the connection bevels of the sides of said slabs, are perpendicularly positioned in respect to one another, and are mutually fixed by means of an adhesive composition.

9. A sink according to claim 8 wherein said connection bevels of said sides are tilted at a predetermined angle (α) (β) of approximately 45° in respect to the lying planes of the slabs (6)(7)(8)(9).

10. The sink according to claim 8 consists of the slabs and has no internal supports for said slabs.

* * * * *